US005904786A

United States Patent [19]

Wendel et al.

[11] Patent Number: 5,904,786

[45] Date of Patent: May 18, 1999

[54] METHOD OF APPLYING PHOSPHATE COATINGS TO METAL SURFACES

[75] Inventors: Thomas Wendel, Schwalbach; Hardy Wietzoreck, Fankfurt am Main; Klaus Bittner, Frankfurt am Main; Peter Schiefer, Frankfurt am Main; Marcus Schinzel, Königstein; Helmut Hülsmann, Kreuztal, all of Germany

[73] Assignee: Metallgesellschaft Aktiengesellschaft, Frankfurt/Main, Germany

[21] Appl. No.: 08/860,350

[22] PCT Filed: Dec. 5, 1995

[86] PCT No.: PCT/EP95/04774

§ 371 Date: Jun. 6, 1997

§ 102(e) Date: Jun. 6, 1997

[87] PCT Pub. No.: WO96/17977

PCT Pub. Date: Jun. 13, 1996

[30] Foreign Application Priority Data

Dec. 9, 1994 [DE] Germany ..... 44 43 882

[51] Int. Cl.[6] ..... C23C 22/07

[52] U.S. Cl. ..... 148/262; 148/253; 148/261; 148/268; 148/273

[58] Field of Search ..... 148/248, 253, 148/261, 262, 268, 273

[56] References Cited

U.S. PATENT DOCUMENTS

| | | | |
|---|---|---|---|
| 3,240,633 | 3/1966 | Gowman et al. | 148/262 |
| 4,264,378 | 4/1981 | Oppen et al. | 148/6.15 R |
| 4,389,260 | 6/1983 | Hauffe et al. | 148/6.15 Z |
| 4,419,199 | 12/1983 | Hauffe et al. | 204/181 R |
| 4,596,607 | 6/1986 | Huff et al. . | |
| 4,761,189 | 8/1988 | Mady et al. | 148/6.16 |
| 5,135,583 | 8/1992 | Gehmecker et al. | 148/262 |
| 5,232,523 | 8/1993 | Endo et al. | 148/262 |

FOREIGN PATENT DOCUMENTS

| | | |
|---|---|---|
| 1 134 246 | 2/1980 | Canada . |
| 1 199 559 | 9/1983 | Canada . |
| 0 015 020 | 2/1980 | European Pat. Off. . |
| 0 015 021 | 2/1980 | European Pat. Off. . |
| 015020 | 9/1980 | European Pat. Off. . |
| 0 039 093 | 3/1981 | European Pat. Off. . |
| 0 056 881 | 11/1981 | European Pat. Off. . |
| 039093 | 11/1981 | European Pat. Off. . |
| 0 064 790 | 5/1982 | European Pat. Off. . |
| 056881 | 8/1982 | European Pat. Off. . |
| 0 135 622 | 8/1983 | European Pat. Off. . |
| 0 106 389 | 9/1983 | European Pat. Off. . |
| 0 111 897 | 12/1983 | European Pat. Off. . |
| 106389 | 4/1984 | European Pat. Off. . |
| 111897 | 6/1984 | European Pat. Off. . |
| 0 565 346 A1 | 7/1993 | European Pat. Off. . |
| 93 30 2702 | 7/1993 | European Pat. Off. . |
| 565346 | 10/1993 | European Pat. Off. . |
| 1 192 515 | 12/1957 | France . |
| 1192515 | 10/1959 | France . |
| 2 601 698 | 7/1986 | France . |
| 2601698 | 1/1988 | France . |
| 2 232 067 | 6/1972 | Germany . |
| 23 27 304 C3 | 12/1974 | Germany . |
| 1 415 999 | 12/1975 | United Kingdom . |
| 2 074 611 | 4/1981 | United Kingdom . |
| 91/02829 | 8/1990 | WIPO . |

*Primary Examiner*—George Wyszomierski
*Assistant Examiner*—Andrew L. Oltmans
*Attorney, Agent, or Firm*—Herbert Dubno

[57] ABSTRACT

A method is disclosed for applying phosphate coatings to surfaces of zinc, iron, aluminum, and the alloys thereof by wetting with a phosphatizing solution containing divalent cations and phosphate to form a liquid film, and subsequently drying on the liquid film wherein the metal surfaces are wetted with a phosphatizing solution, which is free from elements of sub-groups 5 and 6 of the Periodic Table, said phosphatizing solution containing:

0.5 to 8 g/l nickel;

2 to 20 g/l manganese;

18 to 170 g/l of phosphate (calculated as $P_2O_5$);

and has an acid number of 0.4 to 0.8, such that after drying on, a phosphate layer having a weight per unit area of 0.3 to 3.0 g/m$^2$, is obtained, where in the case of phosphatizing surfaces of iron, aluminum or the alloys thereof, the phosphatizing solution necessarily contains 0.5 to 5 g/l of zinc, and in the case of phosphatizing surfaces of zinc or zinc alloys the phosphatizing solution either contains zinc or is free from zinc.

13 Claims, No Drawings

METHOD OF APPLYING PHOSPHATE COATINGS TO METAL SURFACES

FIELD OF THE INVENTION

This invention relates to a method of applying phosphate coatings to surfaces of or zinc, iron, aluminium or the alloys thereof by wetting with a divalent phosphatizing solution containing cations and phosphate and subsequent drying-on of the liquid film.

BACKGROUND OF THE INVENTION

In the metal-processing industry, the method of producing phosphate coatings by means of aqueous zinc phosphate solutions is employed on a large scale. The phosphate layers produced by means of this method on the treated metal surfaces are particularly useful to facilitate sliding, as a preparation for the chipless cold working and for protection against corrosion and as a surface for applying lacquer.

Such phosphatizing solutions usually have a pH-value between 1.8 and 3.8 and contain zinc and phosphate ions as main components. In addition to the cation zinc further cations may be present, e.g. ammonium, calcium, cobalt, iron, potassium, copper, sodium, magnesium, manganese. To accelerate the formation of the phosphate layer, oxidants such as bromate, chlorate, nitrate, nitrite, organic nitro compounds, perborate, persulfate or hydrogen peroxide are generally added to the phosphatizing solutions. To optimize the layer formation on certain materials, there is for instance added fluoride, silicofluoride, boron fluoride, citrate and tartrate. Due to the large number of individual components and their possible combinations there is obtained a plurality of different compositions of the phosphatizing solutions.

A special type of phosphatizing method is represented by what is called the low-zinc methods. The phosphatizing solutions used here contain zinc in concentrations of only about 0.4 to 1.7 g/l and in particular on steel produce phosphate layers with a high content of phosphophyllite, which provides for a better lacquer adhesion and a higher resistance to sub-surface corrosion of the lacquer than is commonly achieved through formation of phosphate layers on the basis of hopeite from phosphatizing solutions with a higher zinc content (DEA-22 32 067, EP-A-15 021, EP-A-39 093, EP-A-56 881, EP-A-64 790, K. Wittel: "Moderne Zinkphosphatierverfahren-Niedrig-Zink-Technik", Industrie-Lackierbetrieb, 5/83, p. 169 and 6/83, p. 210).

A comparatively novel development are the phosphatizing methods which among experts are referred to as trication methods. These are low-zinc phosphatizing methods, where by using nickel in amounts of e.g. 0.3–2.0 g/l and manganese in amounts of e.g. 0.5–1.5 g/l phosphate coatings are obtained which are characterized by an increased alkali resistance and are thus important for cathodic electro-dipcoating, in particular of car bodies.

Especially for phosphatizing galvanized or hot-dip galvanized steel strip, methods have been developed which allow the formation of a phosphate layer corresponding to the trication method within a contact time of 3–8 sec. (EP-A-111 246).

The above-mentioned phosphatizing methods have in common that the phosphatizing solution is brought in contact with the workpiece surfaces to be treated by dipping, flow coating or spraying. After the chemical reaction and upon formation of the firmly intergrown crystalline phosphate layer, the removal of phosphatizing chemicals remaining on the surface requires a rinsing treatment, which is usually performed in several stages. As a result, rinsing solutions are produced, which cannot be disposed of in this form, but must rather be supplied to a liquid-waste disposal system.

Although various suggestions were made for reducing or totally eliminating the amounts of rinsing water, rinsing in what is called a rinsing water cascade for instance involves a considerable reduction of the rinsing water produced. A processing of the rinsing waters even produced in a reduced quantity is, however, inevitable. To avoid rinsing waters it has been proposed to employ a zinc phosphatizing method, whose phosphatizing solutions are composed such that virtually all components can be precipitated by means of calcium hydroxide. In this way, the processing of the rinsing water is facilitated considerably, and at the same time this method has the advantage that water of sufficient quality can be recovered for the process. (DE-C-23 27 304). However, such a process has the disadvantage that due to the request for a precipitability of the constituents of the phosphatizing solution the freedom for the adaptation of the composition of the phosphatizing solution to practical requirements is greatly restricted. Finally, methods of producing a conversion coating are known, where after a possibly necessary cleaning and rinsing with water coating solutions are applied and subsequently dried-on. The application of the treatment solution can be effected by dipping or spraying with subsequent squeezing off the excess solution or by means of roll coating, where only the required amount of liquid is applied onto the metal surface. The process of drying on, which is performed subsequent to the application of the treatment liquid, can in principle already be effected at room temperature. In general, it is, however, common practice to employ higher temperatures, where preferably temperatures between 50 and 100° C. are chosen. Such method designed for the preparation of metal surfaces for the subsequent coating with organic layers consists in wetting the metal surface with a phosphatizing liquid that has a pH-value of 1.5 to 3, is free from chromium and in addition to metal phosphate contains soluble molybdate, tungstate, vanadate, niobate and/or tantalate ions (EP-B-15 020). The cationic component of the metal phosphate in solution may be formed by calcium, magnesium, barium, aluminum, zinc, cadmium, iron, nickel, cobalt and/or manganese.

One disadvantage of the last-mentioned method is that due to the required additions of molybdate, tungstate, vanadate, niobate and tantalate ions the method is more expensive than the conventional phosphatizing methods, and another disadvantage is that the phosphate coatings obtained do not satisfy all the requirements existing today, e.g. as regards the alkali resistance and thus resistance in a subsequent cathodic electro-dipcoating as well as the desired corrosion resistance, in particular in conjunction with a subsequent lacquer coating.

OBJECT OF THE INVENTION

It is the object of the invention to provide a method for applying phosphate coatings to surfaces of zinc, iron, aluminum or the alloys thereof, which does not have the known, in particular the aforementioned disadvantages, is nevertheless inexpensive and easy to perform and leads to high-quality phosphate coatings.

SUMMARY OF THE INVENTION

This object is obtained in that the method as described above is designed in accordance with the invention such that the surfaces are wetted with a phosphatizing solution, which is free from elements of sub-groups 5 and 6 of the Periodic Table, and which contains 0.5 to 8 g/l nickel, 2 to 20 g/l manganese, 18 to 170 g/l phosphate (calculated as $P_2O_5$), and has an acid number of 0.4 to 0.8, such that upon drying-on, a phosphate layer with a weight per unit area of 0.3 to 3.0 g/m is obtained, where in the case of phosphatizing surfaces of iron, aluminum or the alloys thereof the phosphatizing solution necessarily contains 0.5 to 5 g/l zinc, and in the case of phosphatizing surfaces of zinc or zinc alloys the phosphatizing solution may contain zinc ions.

The above wording as regards the zinc content should express that when treating surfaces of iron, aluminum or the alloys thereof, a zinc content in the above concentrations is absolutely necessary. When treating zinc or zinc-alloy surfaces, the phosphatizing solution may likewise contain zinc, but a zinc content is not necessary. Elements of sub-groups 5 and 6 of the Periodic Table are vanadium, niobium, tantalum, chromium, molybdenum and tungsten.

To avoid that after drying-on the phosphate coating has a content of water-soluble compounds, the adjustment of the acid number is expediently effected by means of nickel oxide, manganese oxide or possibly zinc oxide, or by means of ammonia solution.

In accordance with an expedient aspect of the invention it is provided that in the case of the treatment of zinc or zinc alloys the surfaces are wetted with a phosphatizing solution which is free from zinc. In this special case, the zinc quantity required for the formation of the coating originates from the surface of the treated material.

The wetting of the respective metal surfaces can for instance be effected by dipping and subsequent dripping off, by perfusing and centrifuging off, by brushing, by spraying with compressed air, in an airless way as well as in an electrostatic way. A particularly elegant method of applying the phosphatizing solution consists in the cocurrent or counter-current rolling on by means of structured or smooth rollers.

The drying following the wetting of the metal surface can in principle already be effected at room temperature. It is, however, advantageous to use higher temperatures, because this will considerably reduce the time for forming the phosphate layer. Preferably, drying-on is effected at temperatures between 50 and 200° C., where an object temperature of 90° C. should not be exceeded.

A preferred embodiment of the invention consists in wetting the surfaces with a phosphatizing solution, which contains 0.8 to 6 g/l nickel, 3 to 16 g/l manganese, 30 to 140 g/l phosphate (calculated as $P_20_5$), and, when phosphatizing surfaces of iron or aluminum or the alloys thereof, 0.8 to 4 g/l zinc. The aforementioned embodiment of the invention leads to particularly high-quality phosphate coatings.

An additional improvement of the quality of the phosphate coatings can be achieved when in accordance with an advantageous embodiment of the invention the surfaces are wetted with a phosphatizing solution which in addition contains 2 to 10 g/l $SiO_2$ and 0.05 to 0.5 g/l fluoride (calc. as F). Pyrogenic silicic acid is particularly suited as $SiO_2$ because of its good dispersibility. It is advantageously added dispersed in water. Fluoride is expediently introduced in the form of hydrogen fluoride or the aqueous solution thereof. These additives particularly provide for the formation of a uniform and closed coating, which exhibits virtually no inclination for sticking.

Further advantageous embodiments of the invention consist in wetting the surfaces with a phosphatizing solution which has an acid number of 0.5 to 0.7, or in wetting the surfaces with a phosphatizing solution such that after drying-on a phosphate layer with a weight per unit area of 0.5 to 2 g/m$^2$ is obtained.

The adjustment of the preferred acid number of 0.5 to 0.7 is particularly important in the treatment of zinc surfaces with zinc-free phosphatizing solutions, as then the pickling attack of the phosphatizing solution on the zinc surface, which is responsible for the zinc content of the phosphate coating, takes a particularly optimum course. The embodiment of the invention with adjustment of a phosphate coating weight of 0.5 to 2 g/m$^2$ provides for the formation of the phosphate coating within a particularly short period and in addition of particularly high quality.

By means of the method in accordance with the invention phosphate layers are produced which contain 0.5 to 3 wt-% nickel, 1.5 to 8 wt-% manganese, 1.0 to 35 wt-% zinc, and 25 to 40 wt-% phosphate (calculated as $P_{2\ O5}$).

To ensure a perfect wetting with the phosphatizing solution, the metal surfaces should be clean enough. This is generally the case when e.g. strip material is treated by the method in accordance with the invention directly after zinc-plating. However, if the metal surface is oily or contaminated, a degreasing or cleaning by means of methods known per se should first be performed and the surface should then be rinsed.

The phosphatizing solution to be employed in the method in accordance with the invention is expediently used at a temperature in the range from 20 to 80° C. The amount of solution generally lies between 2 and 10 ml per m$^2$ metal surface. Drying-on—if it is done under the influence of heat—is effected virtually immediately after wetting the surface, i.e. after an exposure time of about 0.5 to 5 sec.

The present invention provides a method which is capable of producing phosphate coatings within a few seconds. A further advantage as against known methods consists in the fact that an activating pretreatment prior to phosphatizing can be omitted. The phosphate coatings produced have a particularly high quality as regards the coupling of subsequently applied lacquers, plastics or adhesives. Their quality is comparable with the phosphate layers produced by means of what is called the trication method. This is surprising in so far as the phosphate coatings obtained by means of the inventive method are generally amorphous, whereas the layers formed by means of the trication method are always crystalline.

A further major advantage of the invention consists in the fact that phosphate layers are produced which clearly improve the forming behavior of the metals thus treated, without substantially impairing the weldability.

The phosphate coatings produced by means of the inventive method are quite useful wherever phosphate coatings are being employed. A particularly advantageous application is the preparation of the metal surfaces for the subsequent lacquer coating, in particular the electro-dipcoating.

The method in accordance with the invention is of particularly outstanding importance as regards its application to phosphatizing zinc-plated or zinc alloy-plated steel strips. The term zinc-plated or zinc alloy-plated steel strip refers to strips having a coating of electrolytic zinc (ZE), fire zinc (Z), alloys on the basis of zinc/nickel (ZNE), zinc/iron (ZF) or zinc/aluminum (ZA or AZ). The latter usually also include alloys with e.g. 55 wt-% Al and 45 wt-% Zn.

The invention will now be explained in detail and by way of example with reference to the following Examples.

The values for free acid and total acid indicated in the Examples were determined as follows:

For determining the free acid, 1 ml bath solution upon dilution to about 50 ml with distilled water, possibly by adding $K_3(Co(CN)_6)$ or $K_4(Fe(CN)_6)$ for eliminating disturbing metal cations, by using dimethyl yellow as indicator, is titrated with n/10 NaOH until there is a change from rose to yellow. The used ml n/10 NaOH provide the free acid. 1 ml n/10 sodium hydroxide solution corresponds to 7.098 mg free $P_2O_5$.

The total score (TS) is determined by titrating 1 ml of the phosphatizing solution upon dilution with water to about 50 ml by using phenolphthalein as indicator, until the color changes from colorless to red. The number of ml n/10 sodium hydroxide solution consumed for this purpose provides the total score.

The so-called acid number is obtained by dividing the free acid by the total $P_2O_5$. The total $P_2O_5$ is determined in that subsequent to the determination of the free acid, the titration solution is titrated with n/10 NaOH upon addition of 20 ml 30% neutral potassium oxalate solution against phenolphthalein as indicator, until the color changes from colorless to red. The amount of ml n/10 NaOH used between the change of color with dimethyl yellow and the change of color with phenolphthalein provides the total $P_2O_5$. (cf. W. Rausch "Die Phosphatierung von Metallen" Eugen G. LeuzeVerlag 1988, p. 300 ff.)

EXAMPLE 1

Directly subsequent to the hot-dip zinc plating of steel strip a phosphatizing solution was applied onto the strip surface still 35° C. warm, which solution had the following constituents—dissolved in fully deionized water:

phosphate 69 g/l (calculated as $P_2O_5$)

manganese 7.5 g/l nickel 2.7 g/l

The phosphatizing solution had a temperature of 25° C., a pH-value of 1.7 and an acid number of 0.6. The content of free acid was 5.9 ml, and the content of total acid was 17.1 ml.

The application of the phosphatizing solution was effected by means of a roll coater as it is also used for strip lacquering. The applied wet film of 5 ml phosphatizing solution per $m^2$ metal surface was dried-on at 200° C. in a continuous furnace after an exposure time of 2 sec. When leaving the furnace, the strip had an object temperature of 60° C.

The applied phosphate coating was uniform, closed and had a dry weight per unit area of 1.1 g/$m^2$. It contained 30 wt-% $P_2O_5$, 20 wt-% zinc, 3.5 wt-% manganese and 1.4 wt-% nickel. The strip provided with a phosphate coating by the method in accordance with the invention exhibited an excellent behavior upon deformation, both in the lacquered and in the unlacquered condition. The adhesion and anti-corrosion values of subsequently applied organic coatings also corresponded to the current requirements.

The strip phosphatized by the method in accordance with the invention can also be subjected to the process commonly performed in a car factory. This means that the individual body components may first be formed as usual and be composed by welding to form the car body, and then pass through the treatment system cleaning-rinsing-activating-phosphatizing-rinsing-clearing. Phosphatizing is effected for a treatment time of 3.5 min and at a temperature of the phosphatizing solution of 52° C. The composition of the phosphatizing solution is as follows:

14 g/l phosphate (calculated as $P_2O_5$)

1.4 g/l zinc 1.0 g/l manganese 1.0 g/l nickel 70 mg/l sodium nitrite 185 mg/l free fluoride.

The content of free acid had a value of 1.5 points, the content of total acid a content of 27.8 points, each measured by using a bath sample of 10 ml. The acid number had been adjusted to 0.08.

The phosphate coating thus produced had a weight per unit area of 2.56 g/$m^2$ and contained 31 wt-% $P_2O_5$35 wt-% zinc, 6.4 wt-% manganese, 1.7 wt-% nickel. Subsequent to the phosphatizing treatment the car bodies are first of all provided with a cathodic electrophoretic dip paint and are subsequently provided with the usual car paint system.

Sample sheets, with which the aforementioned process was simulated, were subjected to the following tests: gravel test plus cyclic VDA-test, natural weathering test, cross-cut adhesion test plus 240 h damp heat/constant atmosphere test.

The tests indicated that the results corresponded in every point to the existing requirements. It turned out in particular that the phosphatizing in the 1st stage yielded equally good results as the phosphatizing in accordance with the conventional trication methods.

EXAMPLE 2

By means of a roll coater, a phosphatizing solution with a temperature of 27° C. and the following composition:

phosphate 134 g/l (calculated as $P_2O_5$)

manganese 14.8 g/l nickel 5.42 g/l was applied onto a galvanized strip surface. The solution had an acid number of 0.62, a content of free acid of 10.3, and a content of total acid of 29.7 (based on a bath sample of 1 ml). The wet film of the solution on the strip surface was 3 ml/$m^2$.

Upon drying the wet film at a furnace temperature of 200° C., a uniform closed phosphate coating with a weight per unit area of 1.6 g/$m^2$ was obtained.

An examination of the phosphate coating with respect to composition, deformability, weldability, adhesion and protection against corrosion of subsequently applied organic lacquer coatings exhibited results which can otherwise be produced by means of the conventional phosphatizing methods according to the trication method.

EXAMPLE 3

Onto a cleaned and rinsed strip surface of steel there was applied by means of a roller mill at room temperature a wet film of 5 ml/$m^2$ of a phosphatizing solution which had the following composition:

134 g/l phosphate (calculated as $P_2O_5$)

14.8 g/l manganese 5.42 g/l nickel 3.33 g/l zinc.

The solution had an acid number of 0.56, a content of free acid of 9.4 and a content of total acid of 29.2 (based on 1 ml bath sample).

Upon drying the wet film at a temperature of 150° C., a uniform and closed phosphate coating with a weight per unit area of 1.0 g/$m^2$ was obtained, which had the following composition: 37 wt-% $P_2O_5$, 4.2 wt-% manganese, 1.6 wt-% nickel, 2.1 wt-% zinc.

An examination of the phosphate coating with respect to adhesion and protection against corrosion of subsequently applied organic lacquer coatings revealed that the existing requirements are fully satisfied.

EXAMPLE 4

Onto the surface of cleaned and rinsed aluminum sheets of the alloy AlMgSi 6 ml/$m^2$ of the phosphatizing solution of Example 3 were applied by means of a roller at room temperature, and the wet film was dried on at 150° C. for a period of 15 sec in a circulating air oven. The dry phosphate layer had a weight per unit area of 1.95 g/$m^2$ and a composition of 37 wt-% $P_2O_5$, 3.9 wt-% manganese, 1.5 wt-% nickel and 1.9 wt-% zinc. Here as well, the properties of the phosphate layer as regards adhesion and protection against corrosion in conjunction with a subsequently applied coating were as expected.

What is claimed is:

1. A method of applying a phosphate coating to a surface selected from the group consisting of iron and aluminum, which consists essentially of the steps of:

(a) wetting the surface with an aqueous phosphatizing solution having an acid number of 0.4 to 0.8, which is free from elements of sub-groups 5 and 6 of the Periodic Table and which comprises:
(1) 0.5 to 8 g/l of nickel;
(2) 2 to 20 g/l of manganese;
(3) 18 to 170 g/l of phosphate, calculated as $P_2O_5$;
(4) 0.5 to 5 g/l of zinc; and
(5) water; to deposit a liquid film on said surface; and (b) drying-on the liquid film deposited on said surface to obtain a phosphate coating with a weight per unit area of 0.3 to 3.0 g/$m^2$.

2. The method of applying a phosphate coating defined in claim 1 wherein the aqueous phosphatizing solution having an acid number of 0.4 to 0.8 comprises:

(1) 0.8 to 6 g/l of nickel;
(2) 3 to 16 g/l of manganese;
(3) 38 to 140 g/l of phosphate, calculated as $P_2O_5$;
(4) 0.8 to 4 g/l of zinc; and
(5) water.

3. The method of applying a phosphate coating defined in claim 1 wherein the aqueous phosphatizing solution having an acid number of 0.4 to 0.8 comprises:

(1) 0.5 to 8 g/l of nickel;
(2) 2 to 20 g/l of manganese;
(3) 18 to 170 g/l of phosphate, calculated as $P_2O_5$;
(4) 0.5 to 5 g/l of zinc;
(5) 2 to 10 g/l $SiO_2$;
(6) 0.05 to 0.5 g/l of fluoride, calculated as F; and
(7) water.

4. The method of applying a phosphate coating defined in claim 1 wherein the aqueous phosphatizing solution has an acid number of 0.5 to 0.7.

5. The method of applying a phosphate coating defined in claim 1 wherein the phosphate coating has a weight per unit area of 0.5 to 2 g/$m^2$.

6. A method of applying a phosphate coating to a surface of zinc or a zinc alloy, which consists essentially of the steps of:

(a) wetting the surface of zinc or a zinc alloy with an aqueous phosphatizing solution having an acid number of 0.4 to 0.8, which is free from elements of sub-groups 5 and 6 of the Periodic Table and which comprises:
(1) 0.5 to 8 g/l of nickel;
(2) 2 to 20 g/l of manganese;
(3) 18 to 170 g/l of phosphate, calculated as $P_2O_5$; and
(4) water; to deposit a liquid film on said surface; and (b) drying the liquid film deposited on the surface of the zinc or zinc alloy to obtain a phosphate coating with a weight per unit area of 0.3 to 3.0 g/$m^2$.

7. The method of applying a phosphate coating defined in claim 6 wherein the aqueous phosphatizing solution having an acid number of 0.4 to 0.8 comprises:

(1) 0.8 to 6 g/l of nickel;
(2) 3 to 16 g/l of manganese;
(3) 38 to 140 g/l of phosphate, calculated as $P_2O_5$; and
(4) water.

8. The method of applying a phosphate coating defined in claim 6 wherein the aqueous phosphatizing solution having an acid number of 0.4 to 0.8 comprises:

(1) 0.5 to 8 g/l of nickel;
(2) 2 to 20 g/l of manganese;
(3) 18 to 170 g/l of phosphate, calculated as $P_2O_5$;
(4) 2 to 10 g/l $SiO_2$;
(5) 0.05 to 0.5 g/l of fluoride, calculated as F; and
(6) water.

9. The method of applying a phosphate coating defined in claim 6 wherein the aqueous phosphatizing solution comprises 0.5 to 5.0 g/l of zinc.

10. The method of applying a phosphate coating defined in claim 6 wherein the aqueous phosphatizing solution is free from zinc.

11. The method of applying a phosphate coating defined in claim 6 wherein the aqueous phosphatizing solution has an acid number of 0.5 to 0.7.

12. The method of applying a phosphate coating defined in claim 6 wherein the phosphate coating has a weight per unit area of 0.5 to 2 g/$m^2$.

13. The method of applying a phosphate coating defined in claim 6 wherein the phosphate coating is applied to zinc-plated or to zinc alloy-plated steel strip.

* * * * *